United States Patent [19]

Lucchesi

[11] 4,348,661

[45] Sep. 7, 1982

[54] SELF-BALANCING ALARM SYSTEM

[75] Inventor: Armand P. Lucchesi, Jersey City, N.J.

[73] Assignee: J. C. Penney Company, Inc., New York, N.Y.

[21] Appl. No.: 190,991

[22] Filed: Sep. 26, 1980

Related U.S. Application Data

[63] Continuation-in-part of Ser. No. 963,133, Nov. 22, 1978, abandoned.

[51] Int. Cl.³ ..... G08B 29/00

[52] U.S. Cl. ..... 340/510; 340/506; 340/508; 340/511; 330/9

[58] Field of Search ..... 340/510, 506, 507, 508, 340/509, 511, 500, 501, 515, 660, 661, 662, 663, 664; 330/9; 328/132, 173, 162, 168

[56] References Cited

U.S. PATENT DOCUMENTS

| | | | |
|---|---|---|---|
| 2,575,447 | 11/1951 | Gossick | 340/510 |
| 2,742,634 | 4/1956 | Bergen et al. | 340/510 |
| 2,871,466 | 1/1959 | Vassil et al. | 340/510 |
| 3,646,552 | 2/1972 | Fuhr | 340/510 |
| 3,702,970 | 11/1972 | Stetzler | 330/9 |
| 3,801,972 | 4/1974 | Ho Kim et al. | 340/510 |

*Primary Examiner*—John W. Caldwell, Sr.
*Assistant Examiner*—Donnie Lee Crosland
*Attorney, Agent, or Firm*—Daniel N. Calder

[57] ABSTRACT

An alarm system includes a security loop comprising a plurality of sensors, a circuit connected to the security loop and an alarm. The circuit is responsive to a change in condition within the security loop, and upon any change over a threshold value or substantially any change which is rapid, irrespective of value, the responsive circuit functions to enable the alarm. The alarm may be of audible and/or visual-type with additional capability of signalling a remote control center. The responsive circuit includes a network for self-balance thereby to compensate for changes which are responsive to ambient conditions.

2 Claims, 1 Drawing Figure

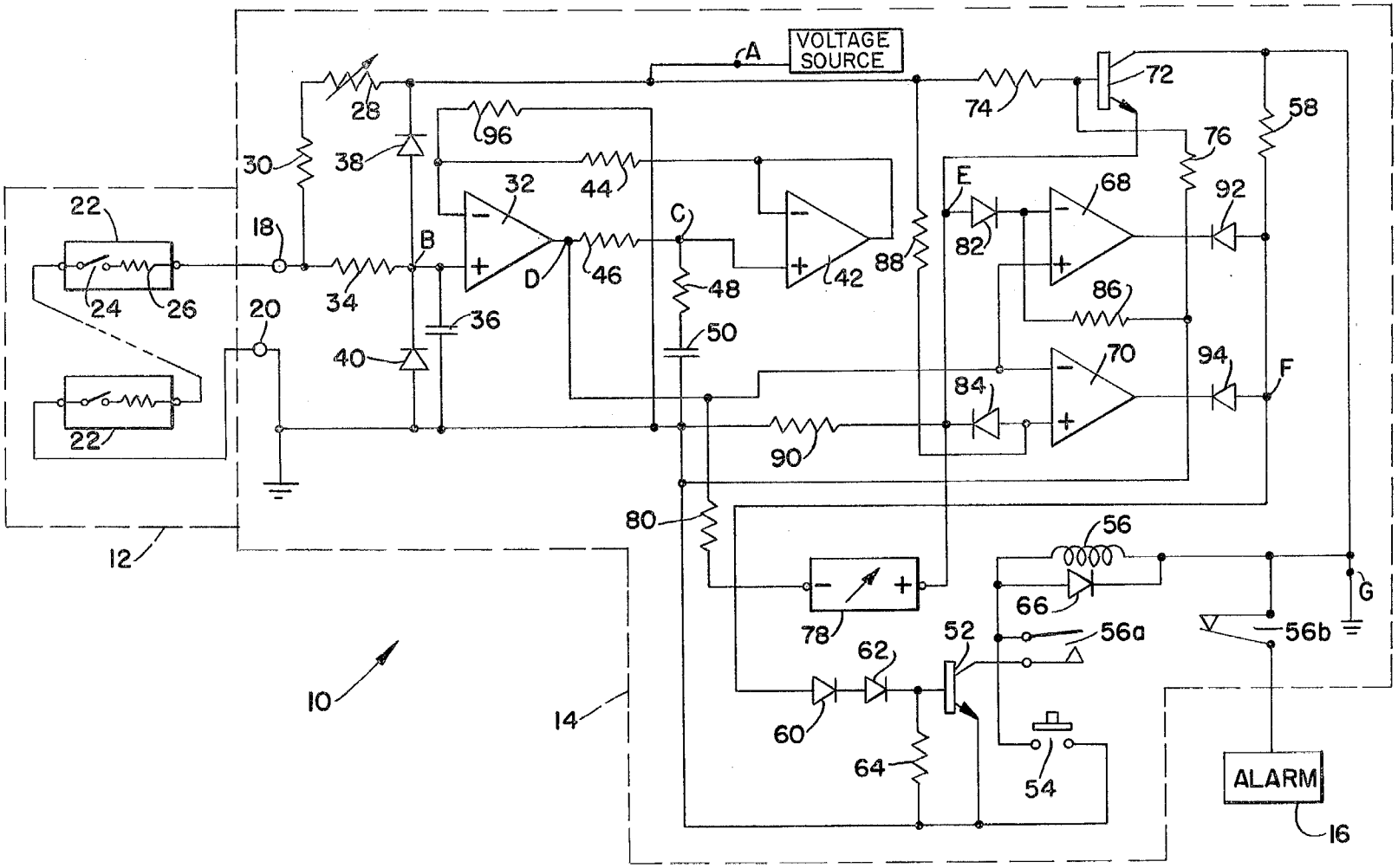
VOLTAGE SOURCE
ALARM
A
B
C
D
E
F
G
10
12
14
16
18
20
22
24
26
28
30
32
34
36
38
40
42
44
46
48
50
52
54
56
56a
56b
58
60
62
64
66
68
70
72
74
76
78
80
82
84
86
88
90
92
94
96

SELF-BALANCING ALARM SYSTEM

CROSS REFERENCE TO RELATED APPLICATION

This application is a continuation-in-part of U.S. patent application Ser. No. 963,133, filed Nov. 22, 1978, Armand P. Lucchesi, inventor, now abandoned.

DESCRIPTION

1. Technical Field

The present invention relates to an alarm system having a security loop and adapted to respond to an unauthorized entry or attempted entry into a zone or space protected by the security loop.

2. Background Art

Alarm systems of the general type described herein, that is, an alarm system which is responsive to an unauthorized entry into a protected zone or space, are known in the art.

Many of these alarm systems, however, suffer from a major problem in that a skillful intruder generally is able to defeat the alarm system and render it inoperative by shorting the condition sensing switches or the wires connecting the switches in a circuit. Actually, the alarm system is operative but the shorting of the condition sensing switches or the wires is unrecognizable since the alarm system is sensitive to an open circuit condition, only. In an attempt to overcome this problem, alarm systems known in the art have been arranged so that the security loop around the zone or space to be protected is located so as to be inaccessible to those outside of the zone or space. This manner of utilization of the alarm system as may be readily appreciated can be quite costly because of the necessity to route the security loop within the walls of the zone or space to be protected.

U.S. Pat. No. 3,997,890 to E. M. Kendrick, Jr. describes an alarm system including a bridge circuit and discloses that the alarm system will respond in the event of an intruder tampering with a sensor either by opening or short circuiting an internal switch. In this event, it is disclosed that the output of the bridge circuit is reduced by at least one-half. Kendrick also discloses that the alarm system will respond to an attempt to conceal removal of a sensor by inserting a low impedance voltage source into the bridge circuit. In this event, however, Kendrick indicates that the output of the bridge circuit is increased.

The alarm system of Kendrick comprises a rather complex circuit arrangement whereby a zone or space to be protected is secured by a bridge circuit including a plurality of switches and a diode, which either may be located in series or in parallel to a respective switch. Circuit sensitivity wherein the bridge circuit comprises four switches is such that it responds to a drop in output by about one-half when a sensor is opened or short circuited.

The alarm system of the present invention improves upon known alarm systems, such as that of Kendrick, by providing a rather uncomplex electrical system sensitive to a change in condition within a security loop that either may be rapid or of longer standing duration, during which time the change exceeds a threshold value. The change may be one which is either positive or negative and one which may result from a change in resistance in the security loop. Such change may be indicative of an open-circuit condition, as well as both a long and short-term change in resistance in the security loop indicative of a short circuit condition or an unsuccessful attempt in shunting a sensor. Since the alarm system of the present invention is substantially tamperproof, the security loop may be routed through nonsecurity areas. In this manner, significant installation costs and/or labor may be avoided substantially without any compromise in the degree of security expected.

Disclosure of the Invention

The alarm system of the invention includes a security loop, an alarm, and a circuit connected to the security loop responsive to a change in condition in the security loop. The security loop preferably includes a plurality of sensors, each having a known impedance value, arranged in series such that the total impedance of the security loop as seen by the responsive circuit is equal to the summation of the individual impedance values. Preferably, also, the impedance values will be equal. Each sensor, for example, may be of a type to respond to an unauthorized entry into a zone or space by opening a barrier, such as a door or window protected by a sensor, or to the existence of an emergency condition, such as a fire in the region of the zone or space.

While the alarm system has a broad application of use, it will be described in connection with the first of the above-mentioned applications. To this end, the individual sensors may comprise an operator, such as a switch or the equivalent. As an important aspect of the invention, the change in condition to which the circuit responds is one which may result from the opening of a switch in the security loop as an incident of an unauthorized entry. The change in condition to which the circuit will respond may also result from the shorting of a sensor and, with a significant degree of certainty, from a tampering with a sensor, for example, by attempting first to shunt the sensor with a potentiometer of high impedance value and then to change (lower) the impedance value slowly to short the sensor. The aforementioned changes in condition may comprise a change, such as a change in voltage level at the input of the responsive circuit, equal to or greater than a threshold value. As a further important aspect of the invention, the circuit responds to a change in condition in the security loop, irrespective of the amount of change, if the change occurs rapidly. A rapid change to which the circuit responds is one which occurs at a rate faster than the time required for the responsive circuit, in balance to self-balance.

These occurrences may be considered as dynamic changes whereby the responsive circuit functions to activate the alarm. The alarm system, as will also be discussed, also responds to static changes. Static changes, such as shorting out a sensor, are changes introduced when the alarm system is in a passive or unarmed condition. This "response" may be recognized as an inability to set or arm the alarm system in the first instance. The alarm system may be provided with an indicator light and/or have capability of receipt of an acknowledging signal from a remote location to advise the operator that the alarm system is set or armed.

These features of the invention permit the installation of the electrical wiring comprising the security loop on the outside of the zone or space being protected. Accordingly, the cost of installation of the alarm system is significantly less than the cost of prior alarm systems which, because of vulnerability both to the static and dynamic changes described, require that the wiring be within the zone or space being protected.

These and other features and advantages of the present invention will become more clear as the description continues.

BRIEF DESCRIPTION OF THE DRAWING

The FIGURE is a schematic presentation of the alarm system of the present invention.

BEST MODE FOR CARRYING OUT THE INVENTION

Referring to the FIGURE, the alarm system 10 includes a security loop 12, a circuit 14 which is responsive to a change in condition in the security loop and an alarm 16 activated by the responsive circuit at such time that the change which is sensed either equals or exceeds a threshold value or the change from a steady state condition is rapid. As illustrated, the security loop is connected to the responsive circuit at terminals 18 and 20. The alarm is connected to the responsive circuit in a manner as will be described.

The alarm may provide an audible and/or visual warning both at the situs of the zone or space which is protected and at a remote location, or at one location or the other and, in addition or as an alternative, the alarm may be in the form of a coded signal to be received at the remote location. In this manner, corrective action may be initiated. Apparatus capable of providing these functions are well known in the art. Preferably, the alarm will be associated with delay circuitry so that when the alarm system is set or armed it may be deactivated following an authorized entry into the zone or space. Circuitry of this type is well known in the art, also.

The security loop 12 includes a plurality of sensors $21_1$, $22_2$ . . . $22_n$ connected in series to the terminals 18 and 20. Each sensor is defined by a switch 24 and a resistor 26. The switch may be a single-pole, single-throw switch or, for example, a switch which may be activated open upon the breaking of a barrier, such as a door or window. These switches are well known and their manner of installation, that is, to open when and in response to an unauthorized entry through the barrier is self-evident. At least in the former instance, the switch and resistor will be sealed within a housing, illustrated by the box in the FIGURE such that only the connecting wires are accessible.

The resistors in the security loop and resistors 28 and 30 form a voltage divider between a voltage source at point A and ground. The voltage level at point B, corresponding to the positive input terminal of operational amplifier 32 will approximate the voltage drop through the security loop. This is the case since the input impedance of the operational amplifier is typically high. The voltage source at point A provides a regulated voltage for reasons as will become clear. The particular voltage level may be determined. In the embodiment of the invention described, the voltage is 10 volts. The resistor 28 is capable of adjustment for the reason as will also become clear.

A resistor 34 is connected between the terminal 18 and point B and capacitor 36 connects point B to ground. The resistor and capacitor provide a trip resistance at high frequency (a frequency above about 8 Hz) and, in conjunction with the diodes 38 and 40 connected between the regulated source at point A and ground, protect the positive input of amplifier 32 from damage in the event that high voltage should momentarily be impressed across the security loop.

An operational amplifier 42 has its positive input terminal connected to the output of amplifier 32. The amplifiers comprise a high-pass active filter connected in negative feedback style. Amplifier 42 functions as a unity gain, non-inverting buffer; while the gain characteristic of amplifier 32, from point B to D is a function of frequency, i.e., how fast the voltage of the security loop may vary.

The following table illustrates voltage gain (approximate) at various frequencies:

| Frequency | Voltage Gain (B to D) |
|---|---|
| DC (steady state) | 1.68 |
| 0.05 Hz | 2.40 |
| 7.0 Hz | 200.0 |
| >7.0 Hz | 300.0 (max.) |

As illustrated, the output of amplifier 32 is connected to the positive differential input of amplifier 42, whose output is directly returned to its negative differential input terminal, and connected to the negative differential input terminal of amplifier 32 through resistor 44. The circuit comprised of amplifier 32 and amplifier 42 functions as a self-balancing or null-seeking circuit. As such, a change in the condition of the security loop represented by a difference in voltage level at point B may be matched or at least minimized by the feedback voltage from amplifier 42. To this end, except for the circuit to be described, it is to be expected that the voltage level at point C would instantaneously follow that at point D and self-balance would occur almost simultaneously.

As previously noted, a change in condition indicating the compromising of the security loop may result from opening a secured barrier whereupon the switch of that sensor is opened, or from shorting of sensor, or from an attempt to shunt one or more sensors. While the circuit comprised of amplifiers 32 and 42 is capable of balancing itself almost instantaneously, self-balancing is prevented by the restraining action of the network comprising resistor 46 connecting points C and D and both resistor 48 and capacitor 50 connecting point C to ground. The particular time-constant of that R-C network may be set by proper selection of values of resistance and capacitance. For the sake of discussion, assume that the time-constant is one of several milliseconds in duration. Thus, changes in the security loop will not be recognized at point C until after the passage of several milliseconds, at which time self-balance is possible. If the change occurs within the period of the time-constant, considered herein as a "rapid change," the responsive circuit will enable activation of alarm 16. For all intents and purposes, the R-C network has effect, only, to allow for self-balancing of the alarm system in response to a change in condition which may result from an ambient change. If the change in condition results from one of the aforementioned occurrences the alarm system has no ability to self-balance and prevent the alarm. To this end, the change undoubtedly will be of sufficient rapidity to increase the gain of amplifier 32 and the voltage at point D to activate alarm 16.

Resistor 48 provides circuit stability by limiting the closed-loop gain from point B to D at frequencies higher than about 10 Hz. Amplifier 42 permits unloading of capacitor 50.

The security loop 12 preferably will include a number of sensors such that a shorting of a sensor will change the resistance of the security loop by a value of about 10%. Actually, the responsive circuit 14, when balanced, will respond to a change in resistance of the security loop of about 0.1% (resulting in a +/−2 millivolt change, utilizing a sensor resistance of 120 ohms, at point B) after taking into account the resistance of resistors 28 and 30. Clearly, in order to obtain this degree of precision in enablement of the alarm, the voltage source at point A should be regulated voltage.

In order to maintain a high tamper resistance at each sensor and facilitate the identification of a compromised or faulty, sensor or sensors, the preferred embodiment of the invention will include 8–10 sensors in the security loop. The description to follow will be based upon the incorporation of eight (8) sensors, each of a resistance of 120 ohms, in the security loop. If additional sensors are required in the protection of an enclosed zone or space, additional alarm systems may be used.

If the responsive circuit 14 has been set or armed and the security loop remains uncompromised, the voltage at point B will remain constant and transistor 52 will continue to conduct. The alarm will not be enabled. The responsive circuit may be set or armed by closure of switch 54 adapted to complete the circuit from a voltage source at point G to ground. Switch 54 may be a pushbutton switch or the equivalent capable of momentarily closing thereby to energize a relay 56 for closing a relay switch **56*a* which normally is opened. The relay and relay switch comprise a latching circuit and transistor 52 will continue to conduct during the period of time that a voltage in excess of about 0.7 volts is applied to its base. Base voltage is derived through the circuit including the voltage source at point G, resistor 58 and the commonly poled diodes 60 and 62. Resistor 58 is a limiting resistor such that the voltage at point F is substantially less than that of the voltage source at point G. The voltage source may provide an unregulated voltage of approximately 12–15 volts. The voltage at point F accordingly will be approximately 2 volts. Resistor 64 provides a discharge path for the collector/base leakage current of transistor 52**.

Upon setting or arming the responsive circuit 14, a relay switch **56*b* connecting the alarm 16 to the voltage source at point G will open. Thereafter, a change in condition in the security loop, as sensed at points B and D, will enable alarm 16**. The change in condition may be one that is rapid, irrespective of the amount of change, or one that exceeds a threshold value, either in a positive or negative sense.

The enablement of alarm 16 will follow cut off of transistor 52, the opening of the latching circuit and closure of relay switch **56*b*. A diode 66 serves to dissipate current upon collapse of the magnetic field of relay 56. In this embodiment, a noise pulse or the equivalent which may result in momentary cut off of transistor 52 would have little or no effect on the system since relay switch 56*b*** would remain open until the magnetic field collapsed.

This operation will now be discussed.

A pair of amplifiers 68 and 70 function as voltage level comparators which compare the voltage level at point D with a voltage level at point E. For purposes of further discussion, it will be assumed that the voltage level at point E is maintained at a 4.5 volt reference level during conduction of transistor 72 connected between the voltage source at point G and ground. The resistors 74 and 76 form a voltage divider to provide the necessary base voltage so that the transistor will conduct and the 4.5 volt reference level will be maintained. The positive terminal of meter 78 is connected to point E and the negative terminal is connected to point D. The meter 78 may be a zero center (tuning-type) meter and conveniently allows for adjustment of current in the security loop 12 by adjustment of resistor 28 thereby to "center up" the comparators 68 and 70. A resistor 80 connected to the negative terminal will provide balancing sensitivity. When the alarm system is balanced, a steady state voltage level at point B of 2.68 volts will provide a 4.5 volt signal at point D.

As previously indicated, a rapid change in the voltage at point B (see the previous table) will result in the enablement of alarm 16. It has, also, been indicated that a change in voltage at point B which exceeds a threshold value will result in the enablement of the alarm, also. Thus, if the voltage at point B were to change very slowly, for example, by about 12% in either the positive or negative-going direction, one of the comparators 68, 70 will become operative to enable alarm 16. In this event, the voltage at the particular input terminal of a comparator will vary from the centered voltage by an amount at least equal to ±0.5 volts. Particularly, a voltage at point B which shall vary from the steady state (DC) voltage of 2.68 volts by an amount of ±0.3 volts under conditions of substantially zero rate of change will activate the alarm. In the event that the change in voltage at point B shall vary from the steady state (DC) voltage at some measurable frequency, say 0.05 Hz, then a voltage variation of ±0.125 volts will activate the alarm. If, for example, the change in voltage at point B varies from the steady state (DC) voltage at a frequency of 7 Hz, then a voltage variation of ±0.0015 volts is required to activate the alarm. As to the latter, a change in voltage in the security loop of only 0.06% could result in the activation of the alarm if the rate of change occurred at a rate of 7 Hz.

From the above, it is seen that the voltage at point D is dependent upon either one of two factors or a combination of factors including the gain of the amplifier in response to the steady state (DC) component of voltage at point B and the gain of the amplifier in response to a voltage at point B which shall have varied at some rate of change.

A diode 82 having a forward voltage drip is connected between the negative input terminal of comparator 68 and the reference voltage at point E; while a diode 84 having a forward drop is connected between the positive input terminal of comparator 70 and the reference voltage at point E. If the centered voltage is 4.5 volts, the voltage at the negative input terminal of comparator 68, determined by the voltage divider including diode 82 and resistor 86, will be approximately 4 volts and the voltage at the positive input terminal of comparator 70, determined by the voltage divider including diode 84 and resistors 88 and 90 will be approximately 5 volts. A pair of diodes 92 and 94, each of which is poled toward a respective comparator, connects the output of the comparator to point F. In the uncompromised condition of the alarm system, a voltage of approximately 12 volts may be found at the output terminal of each of comparators 68 and 70.

When the responsive circuit 14 is in balance and the voltage level at point D substantially equals the voltage level at point E, transistor 52 remains conducting and alarm 16 will not be enabled. Assume, now, that the voltage at point B follows a rapid rate of change or it changes slowly to a value at least to equal a threshold, as previously discussed, then the voltage at point D will change by at least +/−0.5 volts. That is because of the described gain of amplifier 32. If the voltage level at point D falls to at least a 4.0 volt level, the comparator 68 becomes operative, and if the voltage level at point D rises to at least a 5.0 volt level, the comparator 70 becomes operative. The operation of one or the other of comparators 68 and 70 causes the voltage at point F to drop. The diodes 60 and 62 provide assurance through an additional voltage drop that transistor 52 will cut off.

The resistor 96 together with the resistor 44 functions as a voltage divider in the balancing network of amplifiers 32 and 42.

In a preferred embodiment of the present application, the circuit components, in addition to the resistors 26 of the sensors $22_1$, $22_2 \ldots 22_n$, each of which has a value of 120 ohms, have the following values which are presented, not in a limiting sense, but for purposes of describing an embodiment of the invention which has been operated successfully with a greater degree of specificity. It should be quite apparent, however, that within the scope of the invention, the alarm system may be adapted for operation using components having different values of resistance and capacitance or different solid state components. The values for and the identification of the component described are as follows:

| | | |
|---|---|---|
| | Resistor 28 | 1KΩ |
| | Resistor 30 | 1.5KΩ |
| | Resistor 34 | 3.3KΩ |
| | Resistor 44 | 5.6KΩ |
| | Resistor 46 | 82KΩ |
| | Resistor 48 | 470Ω |
| | Resistor 58 | 10KΩ |
| | Resistor 64 | 47KΩ |
| | Resistor 74 | 1500Ω |
| | Resistor 76 | 1100Ω |
| | Resistor 80 | (det. by meter sensitivity) |
| | Resistor 86 | 10KΩ |
| | Resistor 88 | 10KΩ |
| | Resistor 90 | 5.6KΩ |
| | Resistor 96 | 8.2KΩ |
| | Capacitor 36 | 0.1 μf (rated 100v.) |
| | Capacitor 50 | 47 μf (rated 25v.) |
| Diode (silicon signal) | | |
| | 38 | IN 4148 |
| | 40 | IN 4148 |
| | 60 | IN 4148 |
| | 62 | IN 4148 |
| | 66 | IN 4002 |
| | 82 | IN 4148 |
| | 84 | IN 4148 |
| | 92 | IN 4148 |
| | 94 | IN 4148 |
| Amplifier (Quad Op) | | |
| | 32 | LM 324 |
| | 42 | LM 324 |
| | 68 | LM 324 |
| | 70 | LM 324 |
| Relay | 12v | 30 milliamps |
| | Transistor 52 | 2N 2222 |
| | Transistor 72 | 2N 2222 |

The previous description includes a discussion of the operation of the alarm system upon either an opening of a switch of a sensor by opening a protected barrier or the shorting of a sensor or the security loop itself. The alarm system, also, will function upon an ineffective shunting of a sensor. Thus, assuming a potentiometer was placed across the sensor and assuming also, that the potentiometer had a resistance on the order of greater than 10K, required so that the effective resistance of the sensor would change by an amount less than that required to activate the alarm, it would be necessary to change (lower) the resistance of the potentiometer extremely slowly to a short condition so that the change could be compensated by operation of the amplifiers 32 and 42. This operation is necessarily a long-term operation and it is highly unlikely that a prospective intruder would be able to change the resistance of the sensor at a rate so that the amplifier 32 remains balanced. Further, the potentiometer is unlikely to provide a linear change in resistance through adjustment, particularly at low resistance values.

Noise immunity of the alarm system is quite good. It has been found that the predominant interference of 60 Hz does not present a problem because of the relatively low impedance of the security loop, limited high frequency response of the alarm system amplifier and comparator circuits. Additional noise immunity is obtained by earth-grounding the circuit at point 20.

Having described the invention with particular reference to the preferred form thereof, it will be obvious to those skilled in the art to which the invention pertains after understanding the invention, that various changes and modifications may be made therein without departing from the spirit and scope of the invention as defined by the claims appended hereto.

I claim:

1. A detection circuit for use in an alarm system comprising:

a security loop having a plurality of sensing means adapted to be located at respective entries into a zone under protection;

voltage producing means;

alarm means;

a responsive circuit adapted to respond to a change in condition of said security loop to enable said alarm means from a disabled condition;

said security loop connected between said voltage producing means and ground to provide a predetermined voltage level at an input to said responsive circuit when said security loop is uncomprised;

said responsive circuit including means for linearly balancing a change in voltage at said input from said predetermined voltage level which may be bi-directional to maintain said alarm disabled except when said change equals at least a threshold change in voltage from said predetermined voltage level or said change occurs more rapidly than it can be balanced;

said balancing means comprising a pair of amplifiers connected together in negative feedback fashion, delay means connecting the output of one amplifier to an input of the other amplifier, and the input of said one amplifier comprising said input of said responsive circuit;

two comparators, each said comparator having a pair of input terminals, means providing a reference voltage at one input terminal of each comparator, the other input terminal of each comparator being connected to said output of said one amplifier, said reference voltage at said one input terminal of each comparator differing from the voltage level at said other input terminals by a substantially equal positive and negative value;

said reference voltage providing means comprising two independent sources of a constant voltage potential, voltage divider means connected to each independent source, and each said one input terminal connected to a respective one of said voltage divider means;

one independent source of a constant voltage potential comprising a regulated source of D.C. potential, and said voltage producing means including said regulated source; and said other independent source of a constant voltage potential comprising an unregulated source of D.C. potential, a transistor, the base of said transistor connected to and controlled by said regulated source, while the collector being connected to said unregulated source, and said other independent source of voltage potential being derived at the emitter of said transistor.

2. A detection circuit for use in an alarm system comprising:

a security loop having a plurality of sensing means adapted to be located at respective entries into a zone under protection;

voltage producing means;

alarm means;

a responsive circuit adapted to respond to a change in condition of said security loop to enable said alarm means from a disabled condition;

said security loop connected between said voltage producing means and ground to provide a predetermined voltage level at an input to said responsive circuit when said security loop is uncomprised;

said responsive circuit including means for linearly balancing a change in voltage at said input from said predetermined voltage level which may be bi-directional to maintain said alarm disabled except when said change equals at least a threshold change in voltage from said predetermined voltage level or said change occurs more rapidly than it can be balanced;

said balancing means comprising a pair of amplifiers connected together in negative feedback fashion, delay means connecting the output of one amplifier to an input of the other amplifier, and the input of said one amplifier comprising said input of said responsive circuit;

two comparators, each said comparator having a pair of input terminals, means providing a reference voltage at one input terminal of each comparator, the other input terminal of each comparator being connected to said output of said one amplifier, said reference voltage at said one input terminal of each comparator differing from the voltage level at said other input terminals by a substantially equal positive and negative value; and a transistor, the base of said transistor connected to the output terminals of said comparators, the emitter of said transistor connected to ground, and means connecting an unregulated source of D.C. potential to both the collector of said transistor and said alarm so that when neither of said comparators is operative said transistor will conduct thereby to provide a short circuit to ground and prevent operation of said alarm.

* * * * *